United States Patent [19]

Heitkamp et al.

[11] 4,155,668

[45] May 22, 1979

[54] SEALING MEANS FOR THE DRIVE MEMBERS OF DRIVE SHIELDS

[75] Inventors: Herbert Heitkamp, Werne; Dieter Stuckmann, Selm, both of Fed. Rep. of Germany

[73] Assignee: Gewerkschaft Eisenhutte Westfalia, Westfalia, Fed. Rep. of Germany

[21] Appl. No.: 881,058

[22] Filed: Feb. 24, 1978

[30] Foreign Application Priority Data

Mar. 2, 1977 [DE] Fed. Rep. of Germany ..... 2708988

[51] Int. Cl.[2] ..... E01G 3/02; E21D 9/06

[52] U.S. Cl. ..... 405/145; 405/141

[58] Field of Search ..... 61/84, 85, 42, 63; 49/477; 160/231 A, 235; 52/2

[56] References Cited

U.S. PATENT DOCUMENTS

| | | | |
|---|---|---|---|
| 3,473,829 | 10/1969 | Daniels | 49/477 X |
| 3,581,507 | 6/1971 | Stevens | 61/85 |
| 4,063,425 | 12/1977 | Jutt et al. | 61/85 |
| 4,073,521 | 2/1978 | Mena | 49/477 X |

FOREIGN PATENT DOCUMENTS

| | | | |
|---|---|---|---|
| 561250 | 11/1926 | Fed. Rep. of Germany | 49/477 |

*Primary Examiner*—Dennis L. Taylor

*Attorney, Agent, or Firm*—Thompson, Birch, Gauthier & Samuels

[57] ABSTRACT

The drive members of a drive shield, which are mounted side-by-side for longitudinal displacement as is known per se, are provided with seals or packings to close off the gaps between adjacent members. Each seal or packing is composed of two flexible resilient parts joined to respective drive members. The seal parts slidably engage one another in sealing fashion. The parts of the seal may be of the same or disimilar shape but at least one of the parts is hollow with an interior cavity which can receive pressure medium used to expand the part to urge the contacting surfaces of the parts into close sealing contact. Lubrication between the contacting surfaces to permit sliding can be achieved by employing a suitable lubricating agent as, or in, the pressure medium and by allowing some of the pressure medium to pass from the interior cavity to the contacting surfaces.

13 Claims, 4 Drawing Figures

SEALING MEANS FOR THE DRIVE MEMBERS OF DRIVE SHIELDS

BACKGROUND TO THE INVENTION

The present invention relates in general to drive or knife shields used for forming tunnels or the like and employing a plurality of elongate drive members, sometimes called knives or planks. As is known, these drive members are arranged side-by-side in parallel relationship and are supported and guided for longitudinal displacement on one or more rigid frames. The drive members are advanced in the forward direction, either individually or in groups, in relation to the frame or frames usually by means of double-acting rams. In some drive shields the drive members have rear extensions, sometimes called tails, which project beyond the frame or frames in the rearward direction to form a rear shield. The rear extensions, which are often reduced in relation to the main bodies of the drive members, are used primarily to facilitate the construction of a tunnel lining for example by introducing fluid concrete or pre-cast concrete sections.

Where a drive shield is used in water-bearing strata it is also known to supply compressed air to the interior of the shield to maintain a certain constant pressure therein. This pressure then tends to prevent water seeping into the shield but the drive members should be provided with seals in order to close off the longitudinal gaps therebetween and maintain the pressure in the shield.

The seals also prevent water or the tunnel wall material or concrete used to form a lining from entering the shield. Examples of drive shields employing seals between adjacent pairs of drive members are described in U.S. Pat. No. 4,063,425. Since the drive members move relative to one another the seals are usually subjected to sliding friction and considerable wear can result. Nevertheless it is necessary to provide a tight frictional contact to provide the necessary sealing effect.

A general object of this invention is to provide an improved sealing means for the drive members of a drive shield.

SUMMARY OF THE INVENTION

Sealing means constructed in accordance with the invention may comprise interengaging surfaces at least one of which is defined by a component which is hollow and expandible to increase the contact pressure between surfaces by the admission of pressure medium.

In accordance with the invention, sealing means for a pair of adjacent drive members of a drive shield also comprises interengaging relatively slidable components at least one of which is hollow so as to be expandible by the admission of a suitable pressure medium. This enables selective control of the contact pressure between the components. When the drive members are moved relative to one another the components slide relative to one another and to reduce wear the pressure causing the selective expansion can be relieved. Over a period of time the sealing surfaces of the components will inevitably suffer wear but the selective expansion enables the sealing effect to be preserved.

The invention also provides a drive shield which includes a plurality of elongate drive members which are arranged side-by-side for longitudinal displacement and sealing means for sealing the gap between each adjacent pair of drive members, wherein the sealing means is composed of two flexible components which directly engage one another with relatively slidable surfaces, at least one of said components being expandible through the admission of pressure medium to urge said surfaces into tight sealing engagement.

Preferably the components are flexible and resilient and in one embodiment of sealing means made in accordance with the invention, one of the components has a recess and the other of the components has a portion slidably engaging in and sealing with the recess and said portion of the other components is hollow and can be expanded relative to the recess by the admission of pressure medium.

The components can have main bodies respectively secured to each of a pair of drive members and the components can extend across a gap between the drive members and be spaced therefrom. The components can be secured to the inner faces of the drive members and one component can be shaped to engage tightly against the gap and provide an additional sealing effect when the interior of the shield is subjected to pressure and the components flex towards the gap.

Since the components slide relative to one another as the respective drive members are displaced relative to one another, it may also be desired to provide some means for lubricating the sliding surfaces of the components. In one arrangement the pressure medium or fluid at least contains a lubricating agent and the hollow portion of the appropriate component receiving the pressure medium is provided with bores or the like which lead from the interior to the exterior. In this way some of the pressure medium is allowed to escape between the contacting surfaces of the components to thereby lubricate the surfaces.

In another embodiment of sealing means made in accordance with the invention, both components have the same shape and are both hollow to receive pressure medium. The components can locate at the sides of a pair of drive members. The components are flexible and resilient and can have relatively slidable interengaging projections, such as corrugations, which are urged into tighter sealing engagement upon the ingress of pressure fluid to the components.

Where the drive members provided with sealing means in accordance with the invention become misaligned excessive friction or damage of the sealing components can occur. This problem can however be mitigated by allowing some of the pressure fluid to be taken off via a pressure-relief valve or the like in the event of excessive pressure in the component or components in question.

The invention may be understood more readily, and various other features of the invention may become apparent from consideration of the following description.

BRIEF DESCRIPTION OF DRAWINGS

Embodiments of the invention will now be described, by way of examples only, with reference to the accompanying drawings, wherein.

DESCRIPTION OF PREFERRED EMBODIMENTS

Figure 1:
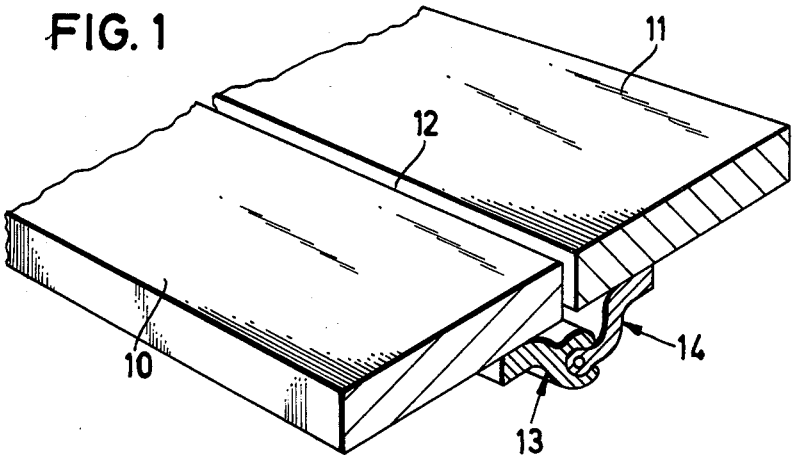
FIG. 1 is a perspective view of parts of a pair of drive members of a drive shield constructed in accordance with the invention.

FIG. 1 of the accompanying drawings shows parts of a pair of elongate parallel drive members 10, 11 of a drive or cutting shield. In known manner, the shield is composed of a plurality of such drive members arranged side-by-side and supported for longitudinal displacement on a frame or frames. Hydraulic rams are usually employed to advance the drive members, individually or in groups, to effect driving of a tunnel or similar underground or below-surface cavity. Each drive member 10, 11 of the drive shield is spaced with longitudinal gaps 12 at its sides from its neighbouring drive members. In accordance with the invention, adjacent pairs of drive members are equipped with sealing means, such as is shown in FIG. 1, to seal off or close the gap 12 therebetween. Since the drive members 10, 11 may be moved relative to one another the sealing means should facilitate this movement.

The sealing means depicted in FIG. 1 is composed of two relatively slidable, flexible, and preferably resilient components 13, 14. The components 13, 14 have main curvilinear bodies 18, 19 and are respectivey secured to the inner sides of the drive members 10, 11 (i.e., remote from the tunnel wall) with the aid of screws 20. The components 13, 14 are designed to mate directly with one another and are preferably constructed from a suitable resilient wear-resistant plastics material. Thus, the component 13 has a recessed portion 15, which may be reinforced, and the other component has a shaped bead-like portion 17 adapted to fit snugly inside the recess 16 of the portion 15. The shaped portion 17 slides within the recess 16 and is also hollow.

A pressure medium or fluid, pneumatic or hydraulic, can be introduced into the interior 21 of the portion 17 to cause the latter to expand thereby to form a hermetic seal between the portions 15, 17.

During operation of the drive shield, the interiors 21 of the portions 17 of the sealing means are preferably maintained under constant pressure but the pressure can be selectively reduced where relative movement occurs between adjacent drive members.

If a pair of drive members become misaligned during operation the portions 15, 17 of the associated sealing means can become jammed or excessive friction and wear can occur. To mitigate this problem, the pressure system for pressurizing the interiors 21 of the portions 17 of the sealing means can have pressure-relief valves or the like which will automatically reduce the pressure within the interior 21 of the portion 17 of the sealing means in question. Automatic control means can operate on the pressure system to ensure that a substantially constant pressure system prevails in the portions 17 of the sealing means when sealing is desired.

Figure 2:
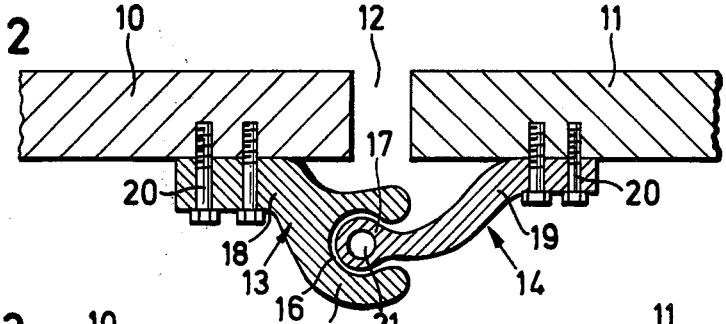
FIGS. 2 and 3 are enlarged cross-sectional views of parts of the drive members depicted in FIG. 1 showing the sealing means thereof in different operating positions.
Figure 3:
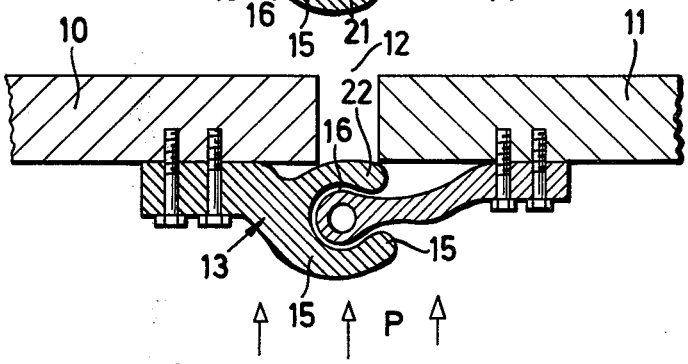

FIG. 2 shows the position of the sealing means 13, 14 when the interior of the drive shield (below the sealing means of FIG. 2) is not subjected to any excess pressure. In contrast, as depicted in FIG. 3, where the interior of the drive shield is subjected to excess pressure, usually by the introduction of compressed air, the sealing means 13, 14 of each pair of drive members becomes pressed towards the drive members by the internal pressure and the portions 15, 17 become more tightly pressed together. As can also be seen in FIG. 3, the curved upper region 22 of the shaped portion 15 of the component 13 is pressed into the gap 12 between the drive members 10, 11 to reliably seal off the interior of the drive shield from the exterior. The combined sealing effect provided by all the sealing means of the drive members of the shield when the interior of the shield is pressurized can still be effective even if the pressure in the interiors 21 of the portions 17 of the sealing means should fall or even fail entirely.

Figure 4:
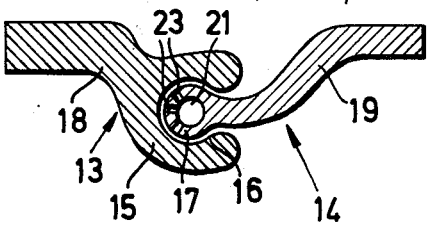
FIG. 4 is a cross-sectional view of a modified form of sealing means.

In the modified form of sealing means depicted in FIG. 4, like reference numerals denote like parts to FIGS. 1–3. In FIG. 4, however, the portion 17 of the component 14 has radial pore-like borings 23 connecting the interior 21 thereof to the exterior. Some of the pressure fluid introduced into the interior 21 can thus escape to flow around the wall of the recess 16 of the component 17 and can act as a lubricant to reduce wear between the engaging surfaces of the portions 16, 17. A suitable lubricating agent is preferably used as the pressure fluid or is included in the pressure fluid. One example of such a pressure fluid is a water-oil or water-bentonite suspension.

Figure 5:
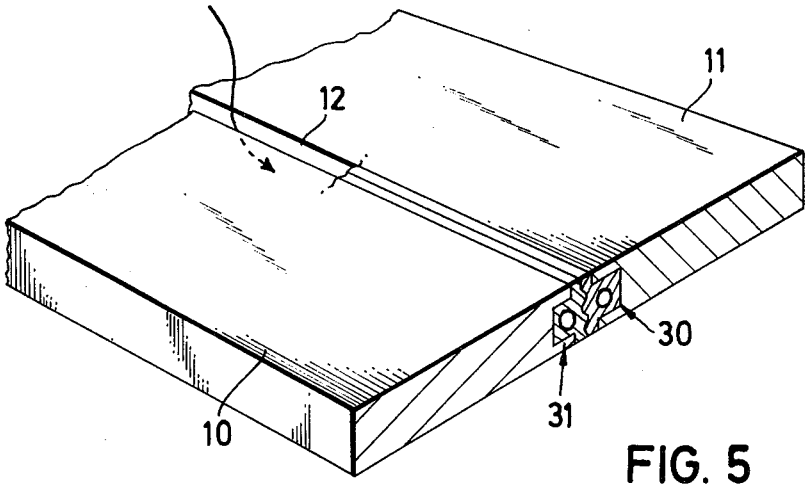
FIG. 5 is a perspective view of parts of a further pair of drive members of a drive shield, constructed in accordance with the invention.
Figure 6:
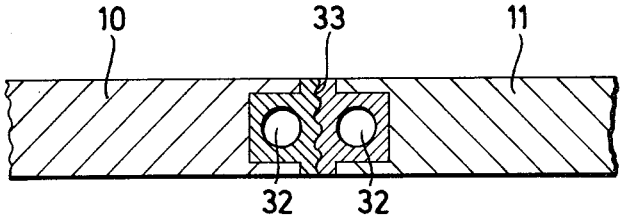
FIG. 6 is an enlarged cross-sectional view of parts of the drive members depicted in FIG. 5.

Another type of sealing means made in accordance with the invention is shown in FIGS. 5 and 6. In contrast to the embodiments represented in FIGS. 1 to 4, the sealing means of FIGS. 5 and 6 is provided at the facing longitudinal side edges of the drive members 10,11 to close off the gap 12 directly. The sealing means in this embodiment takes the form of two interengaging resilient components 30, 31 located in grooves in the sides of the drive members 10, 11. The components 30, 31 have the same shape and have interengaging projections and recesses—here in the form of simple corrugations 33—providing a good sealing effect, while permitting relative longitudinal displacement of the members. The components 30, 31 are again hollow and the interiors 32 would be subjected to pressure fluid to expand the components 30, 31 to cause the components 30, 31 to tightly press against one another. The sealing means 30, 31 is particularly effective in preventing the loss of pressure in the drive shield when the interior of the shield is pressurized as described in connection with FIG. 3. If desired, part of the pressure fluid can be allowed to escape to lubricate the contact surfaces of the components 30, 31 and pore-like bores similar to FIG. 4 can be provided for this purpose.

Certain drive shields employ drive members with rear portions, usually reduced, forming tails which combine to form a rear shield for facilitating the construction of a tunnel lining. In this case sealing means as described can be also provided on the rear portions of the adjacent drive members as well as on the main forward portions thereof. This is particularly useful where the interior of the forward drive shield is pressurized (FIG. 3) since the compressed air can be prevented from entering the fluid concrete used to construct the tunnel lining or otherwise from leaking from the rear shield towards the tunnel wall.

We claim:

1. In a drive shield which includes a plurality of elongate drive members arranged side-by-side for longitudinal displacement, and which further includes a plurality of sealing means for sealing the gaps between each adjacent pair of drive members, the improvement therein comprising: each said sealing means having two elongate flexible components which extend along, and are respectively attached to, the two drive members of the associated adjacent pair of drive members, said two flexible components directly engaging one another with relatively slidable surfaces, at least one of said flexible components being expanded by the admission of pressure medium to urge said relatively slidable surfaces into tight sealing engagement.

2. The improvement according to claim 1, wherein one of said flexible components has a recess and the other of said flexible components has a portion slidably engaging in, and sealing with, said recess, and said portion of said other flexible component is hollow and is expanded relative to said recess by the admission of pressure medium.

3. The improvement according to claim 1, wherein each said flexible component has a main body secured to its adjacent drive member.

4. The improvement according to claim 3, wherein said flexible components extend across and are spaced from the gap between the drive members, the gap being sealed by said flexible components.

5. The improvement according to claim 3, wherein said flexible components are secured to inner faces of the drive members relative to the drive shield.

6. The improvement according to claim 2, wherein the pressure medium at least contains a lubricating agent, and said hollow portion of said other flexible component is provided with borings which lead from the interior to the exterior thereof permitting some of the pressure medium to escape from the hollow portion to the contacting surface of said recess and thereby to act as a lubricant.

7. The improvement according to claim 4, wherein said flexible components are secured to inner faces of the drive members relative to the drive shield, and said recessed component is shaped to engage tightly against the gap and to provide an additional sealing effect when the interior of the shield is subjected to pressure and said components flex towards the gap.

8. The improvement according to claim 1, wherein both said flexible components have the same shape.

9. The improvement according to claim 8, wherein both said flexible components are hollow.

10. The improvement according to claim 8, wherein both said flexible components have relatively slidable interengaging projections and recesses.

11. The improvement according to claim 8, wherein said flexible components are located at longitudinal facing sides of the associated adjacent pair of drive members.

12. A drive shield comprising: a plurality of elongate drive members which are arranged side-by-side for longitudinal displacement, and a plurality of sealing means for sealing the gaps between each adjacent pair of drive members, each said sealing means having two elongate flexible components which extend along, and are respectively attached to, the two drive members of the associated adjacent pair of drive members, said two flexible components directly engaging one another with relatively slidable surfaces, at least one of said flexible components being expanded by the admission of pressure medium to urge said relatively slidable surfaces into tight sealing engagement.

13. The improvement according to claim 12, wherein said expanded flexible component is provided with borings through which lubricant in the pressure medium can pass to lubricate said relatively slidable surfaces.

* * * * *